US007249704B1

(12) United States Patent
Smith

(10) Patent No.: US 7,249,704 B1
(45) Date of Patent: Jul. 31, 2007

(54) MAILBOX MULTI-POSITION SUPPORT SYSTEM

(76) Inventor: Cleve H. Smith, 420 Saddlewood Dr., Gastonia, NC (US) 28056

( * ) Notice: Subject to any disclaimer, the term of this patent is extended or adjusted under 35 U.S.C. 154(b) by 0 days.

(21) Appl. No.: 11/567,045

(22) Filed: Dec. 5, 2006

(51) Int. Cl.
*A47G 29/12* (2006.01)

(52) U.S. Cl. ..... 232/39; 248/131; 248/349.1; 248/125.7; 248/219.2

(58) Field of Classification Search ..... 232/39; D99/32; 248/131, 145, 415, 418, 349.1, 248/125.7, 219.2; 211/77–78
See application file for complete search history.

(56) References Cited

U.S. PATENT DOCUMENTS

| | | | | |
|---|---|---|---|---|
| 3,407,997 | A | 10/1968 | Wood et al. | |
| 4,508,259 | A | 4/1985 | Hicks | |
| 4,667,918 | A | 5/1987 | Page | |
| 4,893,747 | A | 1/1990 | Roth | |
| 5,167,364 | A | 12/1992 | Wenning | |
| 5,400,958 | A | 3/1995 | Walker | |
| 5,437,409 | A | 8/1995 | Coushaine | |
| 5,458,286 | A | 10/1995 | Paschal | |
| 5,622,343 | A * | 4/1997 | Morton | 248/131 |
| 5,699,989 | A * | 12/1997 | Guthrie | 248/219.2 |
| 5,779,202 | A | 7/1998 | Black et al. | |
| 7,032,811 | B1 | 4/2006 | Paulic et al. | |
| 7,195,146 | B1 * | 3/2007 | Dunn et al. | 232/39 |

* cited by examiner

*Primary Examiner*—William L. Miller

(57) ABSTRACT

A mailbox multi-position support system for efficiently providing easy and safe access to mailboxes. The mailbox multi-position support system generally includes a first support member attached to a mailbox post, a rotating member rotatably attached to a first upper horizontal surface of the first support member and a second support member attached to a second upper horizontal surface of the rotating member, wherein a third upper horizontal surface of the second support member attaches to a mailbox, wherein the mailbox rotates about the first support member via the rotating member.

20 Claims, 7 Drawing Sheets

MAILBOX MULTI-POSITION SUPPORT SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to mailboxes and more specifically it relates to a mailbox multi-position support system for efficiently providing easy and safe access to mailboxes.

2. Description of the Related Art

Any discussion of the prior art throughout the specification should in no way be considered as an admission that such prior art is widely known or forms part of common general knowledge in the field.

Mailboxes have been in use for years. Typically, mailboxes consist of a box or container like device mounted on a post. Previous mailboxes are mounted in a fixed position and generally include a front access in which mail may be inserted or removed from the mailbox. Generally the front opening in the mailbox allows for easy insertion of mail into the mailbox by the mailman because the front opening is generally facing the roadway.

It can be dangerous and difficult for many residents to retrieve their mail from the front of the mailbox. The resident must stand in the way or park their vehicle in the way of oncoming traffic in order to retrieve their mail. Retrieving mail can be exceptionally dangerous for mailboxes along the sides of busy highways or any busy roadway.

Attempts have been made to develop a mailbox in which the user may gain access to their mail without being in front of the mailbox. These designs have generally been complicated to use and/or install which has made them more of a hassle than a benefit. Because of the general lack of efficiency and practicality in the prior art there is the need for a new and improved rotatable mailbox for efficiently providing easy and safe access to mailboxes.

BRIEF SUMMARY OF THE INVENTION

The general purpose of the present invention is to provide a mailbox multi-position support system that has many of the advantages of the mailboxes mentioned heretofore. The invention generally relates to mailboxes which includes a first support member attached to a mailbox post, a rotating member rotatably attached to a first upper horizontal surface of the first support member and a second support member attached to a second upper horizontal surface of the rotating member, wherein a third upper horizontal surface of the second support member attaches to a mailbox, wherein the mailbox rotates about the first support member via the rotating member.

There has thus been outlined, rather broadly, some of the features of the invention in order that the detailed description thereof may be better understood, and in order that the present contribution to the art may be better appreciated.

There are additional features of the invention that will be described hereinafter and that will form the subject matter of the claims appended hereto.

In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

An object is to provide a mailbox multi-position support system for efficiently providing easy and safe access to mailboxes.

Another object is to provide a mailbox multi-position support system that is rotatable to a plurality of various positions.

An additional object is to provide a mailbox multi-position support system that is easily operated.

A further object is to provide a mailbox multi-position support system that may be installed to an existing mailbox structure.

Another object is to provide a mailbox multi-position support system that is economically priced.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
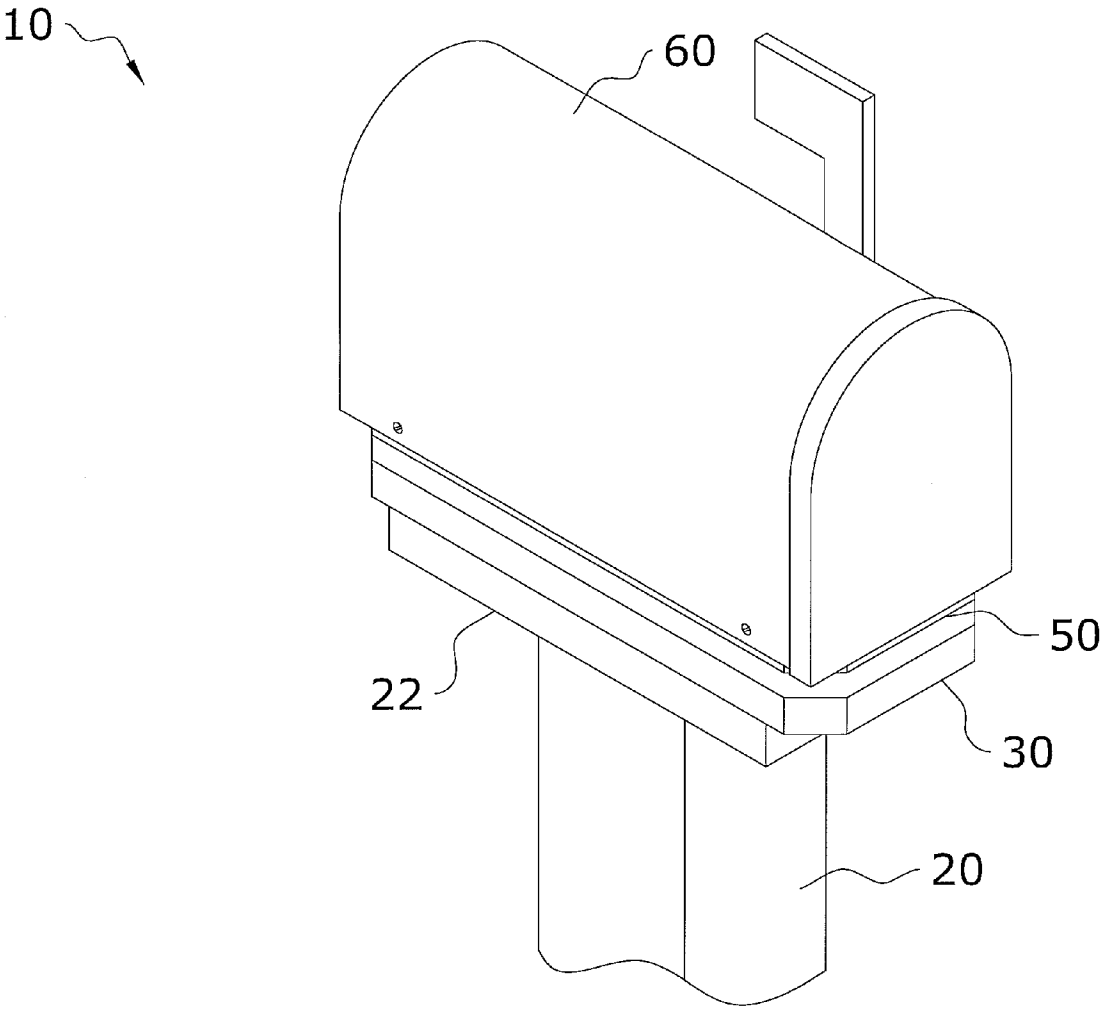
FIG. 1 is an upper perspective view of the present invention in a first position.

Turning now descriptively to the drawings, in which similar reference characters denote similar elements throughout the several views, FIGS. 1 through 7 illustrate a mailbox multi-position support system 10, which comprises a first support member 30 attached to a mailbox post 20, a rotating member 40 rotatably attached to a first upper horizontal surface of the first support member 30 and a second support member 50 attached to a second upper horizontal surface of the rotating member 40, wherein a third upper horizontal surface of the second support member 50 attaches to a mailbox 60, wherein the mailbox 60 rotates about the first support member 30 via the rotating member 40.

B. First Support Member

Figure 3:
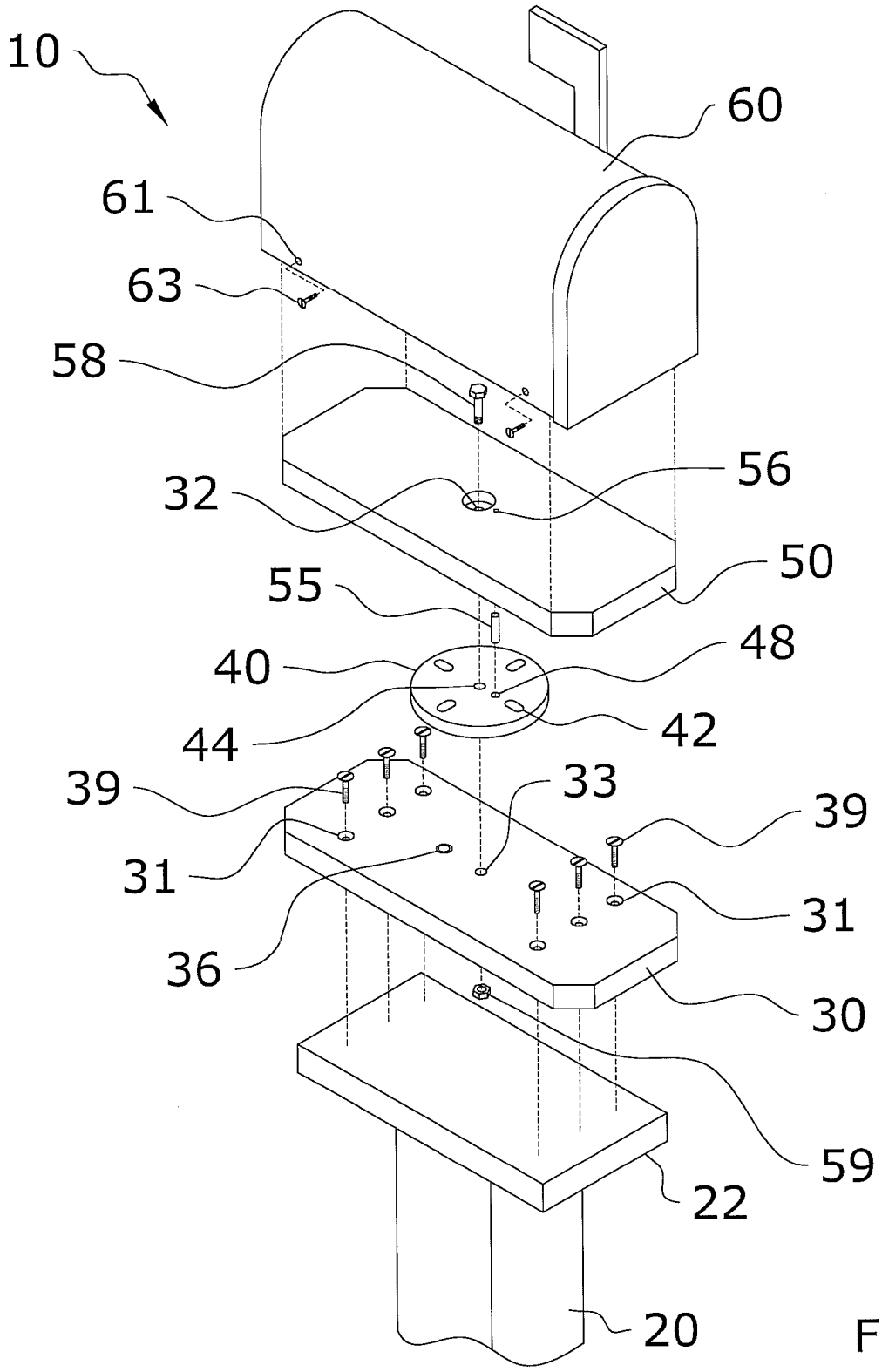
FIG. 3 is an exploded upper perspective view of the present invention.

The first support member 30 is preferably comprised of a rectangular shaped configuration as illustrated in FIG. 3. The first support member 30 is also preferably substantially similar in size and shape to the base of the mailbox 60 utilized with the mailbox multi-position support system 10. The first support member 30 is also preferably comprised of a strong and weatherproof material, such as but not limited to wood, plastic or metal.

Figure 2:
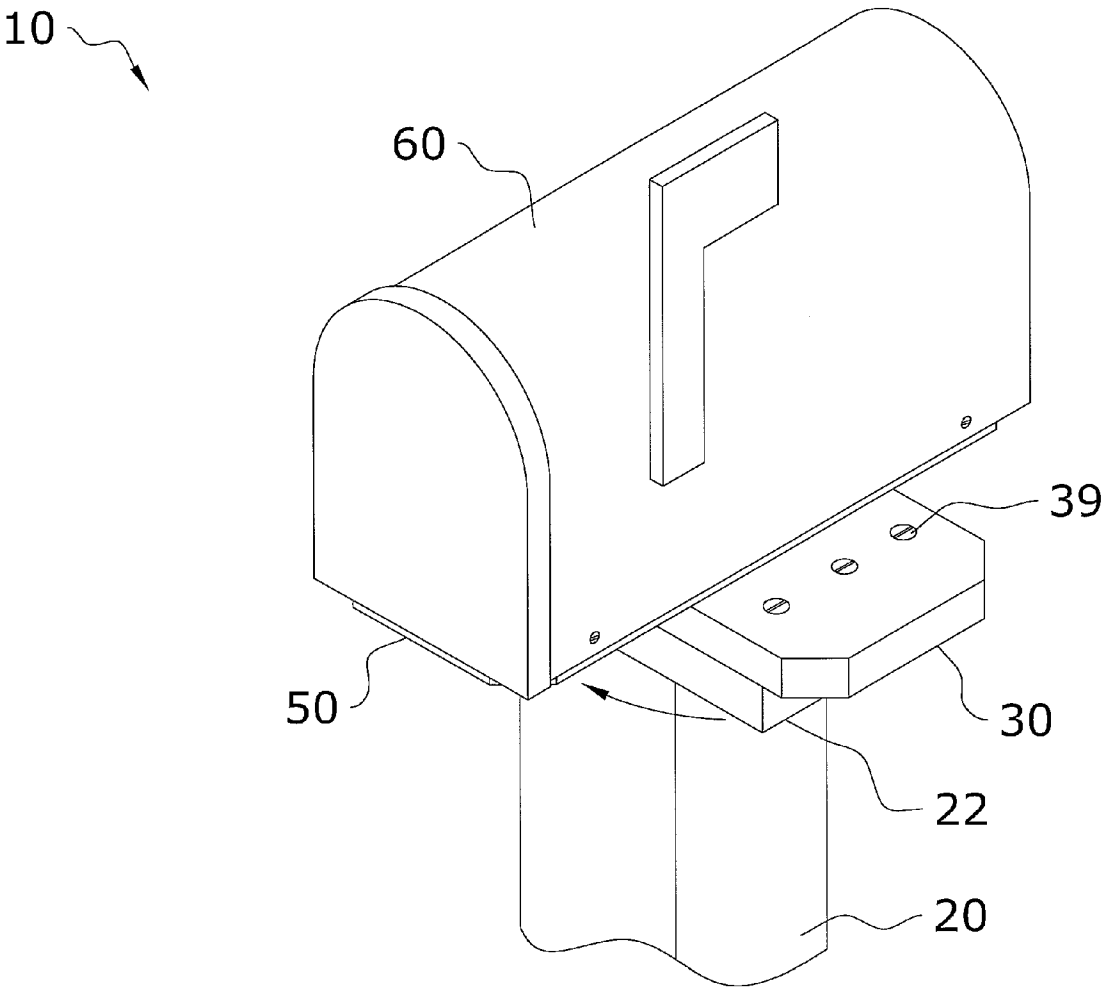
FIG. 2 is an upper perspective view of the present invention in a second position.

The four outer corners of the support member are preferably comprised of a rounded or slanted configuration as illustrated in FIGS. 1 through 3. The configuration of the four outer corners to be rounded or slanted is preferably so the first support member 30 does not get in the way of a person or object while rotating the mailbox multi-position support system 10.

The first support member 30 preferably includes a plurality of first mounting apertures 31. The first mounting apertures 31 are preferably positioned on the longitudinal outer ends of the first support member 30. The first mounting apertures 31 also preferably extend vertically through the first support member 30 and are countersunk to flushably receive a first fastener 39 as shown in FIGS. 1 through 6.

The first fastener 39 preferably extends through the first support member 30 and attaches the first support member 30 to a mounting member 22 of a mailbox post 20 as shown in FIGS. 1 through 6. The mounting member 22 of the mailbox post 20 may be comprised of various configurations all which are capable of supporting the first support member 30 upon the mailbox post 20. The mailbox post 20 is also preferably comprised of a standard mailbox post 20 configuration. The first fastener 39 is preferably comprised of a screw, bolt or nail configuration.

The first support member 30 also preferably includes a channel member 36 positioned within the first support member 30. The channel member 36 is preferably comprised of a tubular configuration. The channel member 36 is preferably positioned substantially offset from a concentric origin of the first support member 30 or within a radius of the rotating member 40 with respect to a first pivot aperture 33 as shown in FIGS. 3 through 6. The channel member 36 preferably includes a locking member 37 and a spring 38 positioned within the channel member 36.

The spring 38 is preferably positioned within a lower end of the channel member 36. The locking member 37 is preferably positioned upon or attached to an upper end of the spring 38. The locking member 37 is further preferably positionable within the channel member 36. The locking member 37 is preferably comprised of a ball bearing configuration; however it is appreciated that the locking member 37 may be comprised of a plurality of configurations all which may be positioned within the channel member 36. The locking member 37 and spring 38 are further preferably comprised of a standard spring plunger configuration as illustrated in FIGS. 4 through 6.

Figure 4:
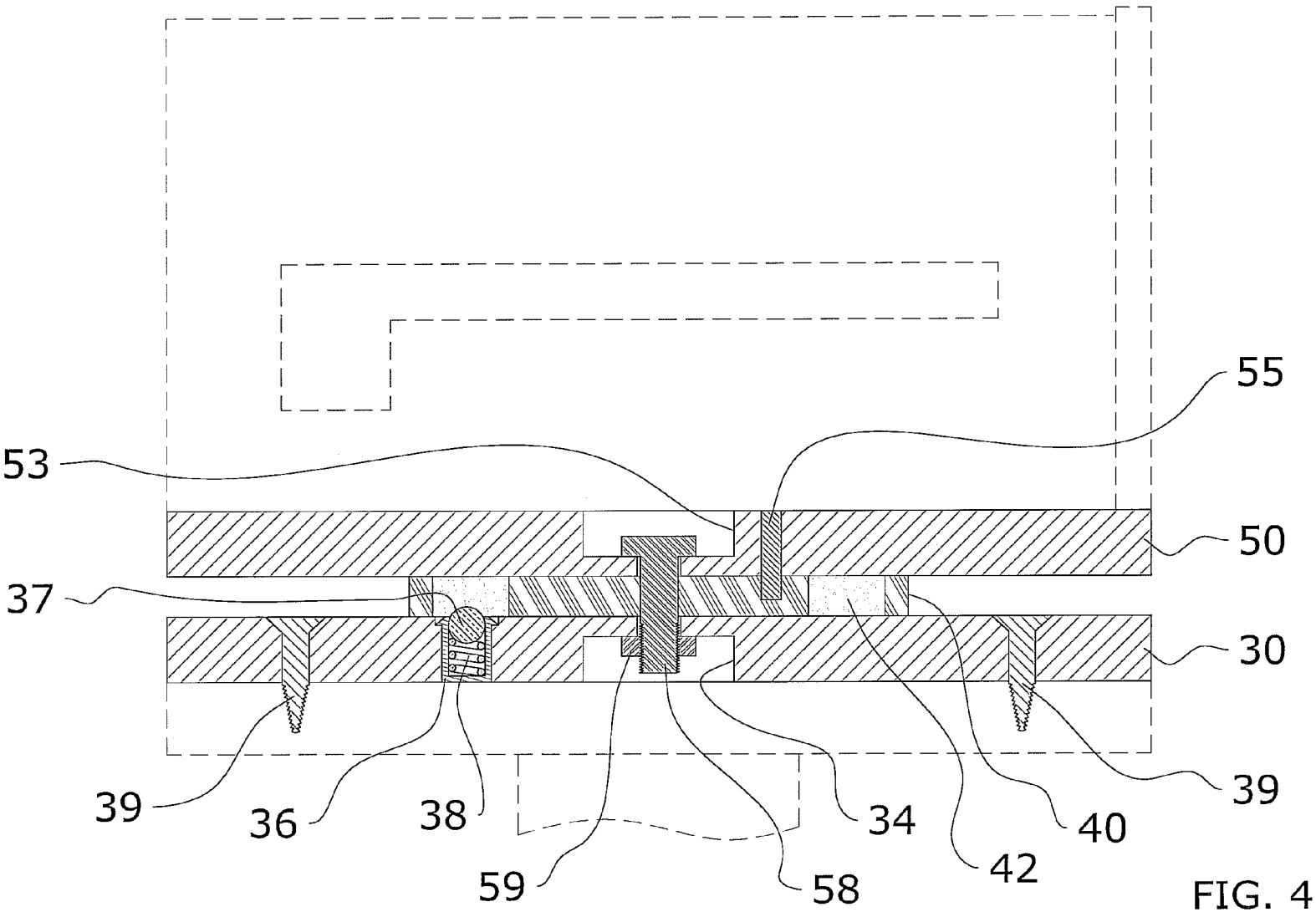
FIG. 4 is a cross-sectional view of the present invention in a first position.
Figure 5:
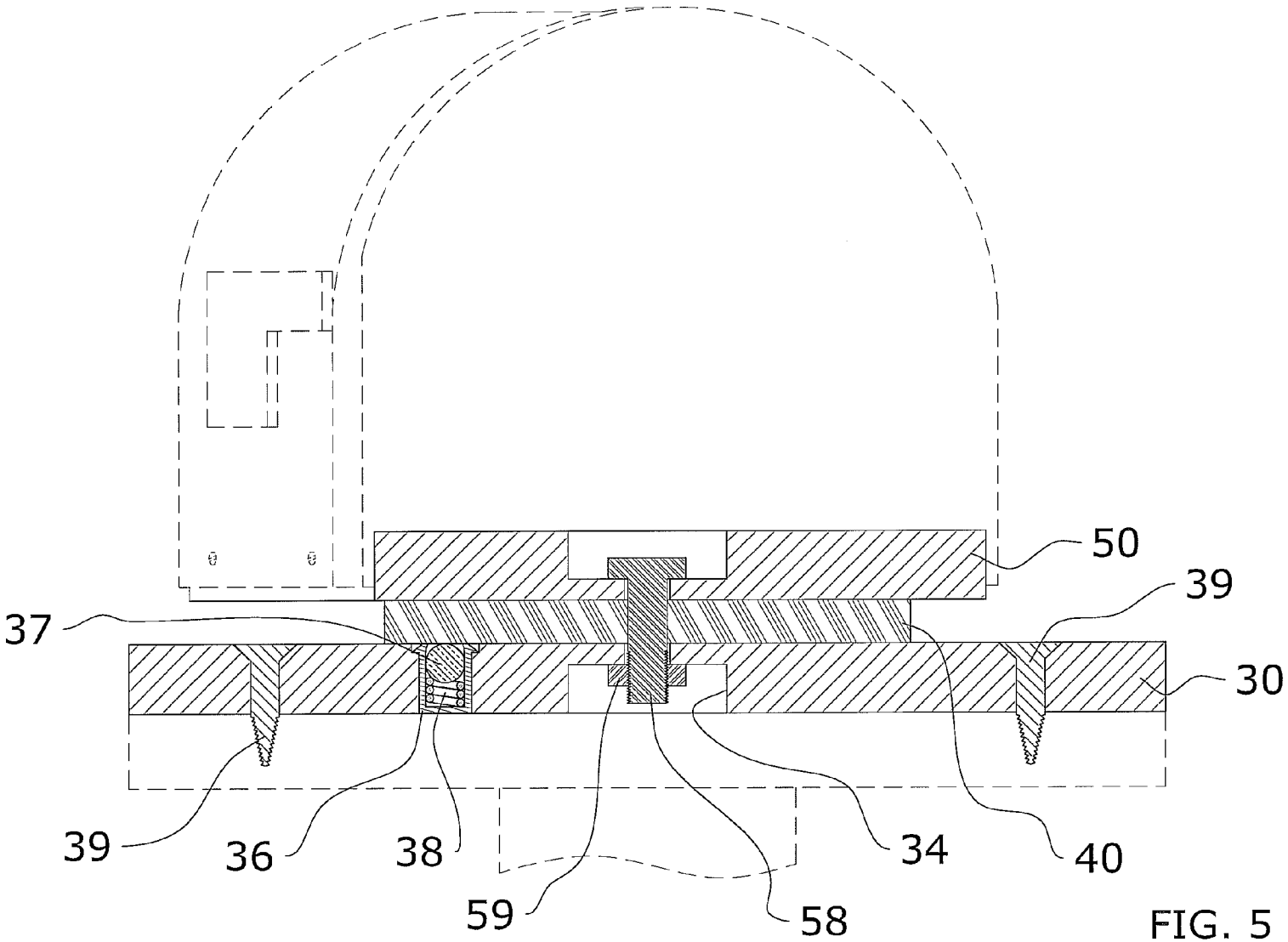
FIG. 5 is a cross-sectional view of the present invention being rotated.
Figure 6:
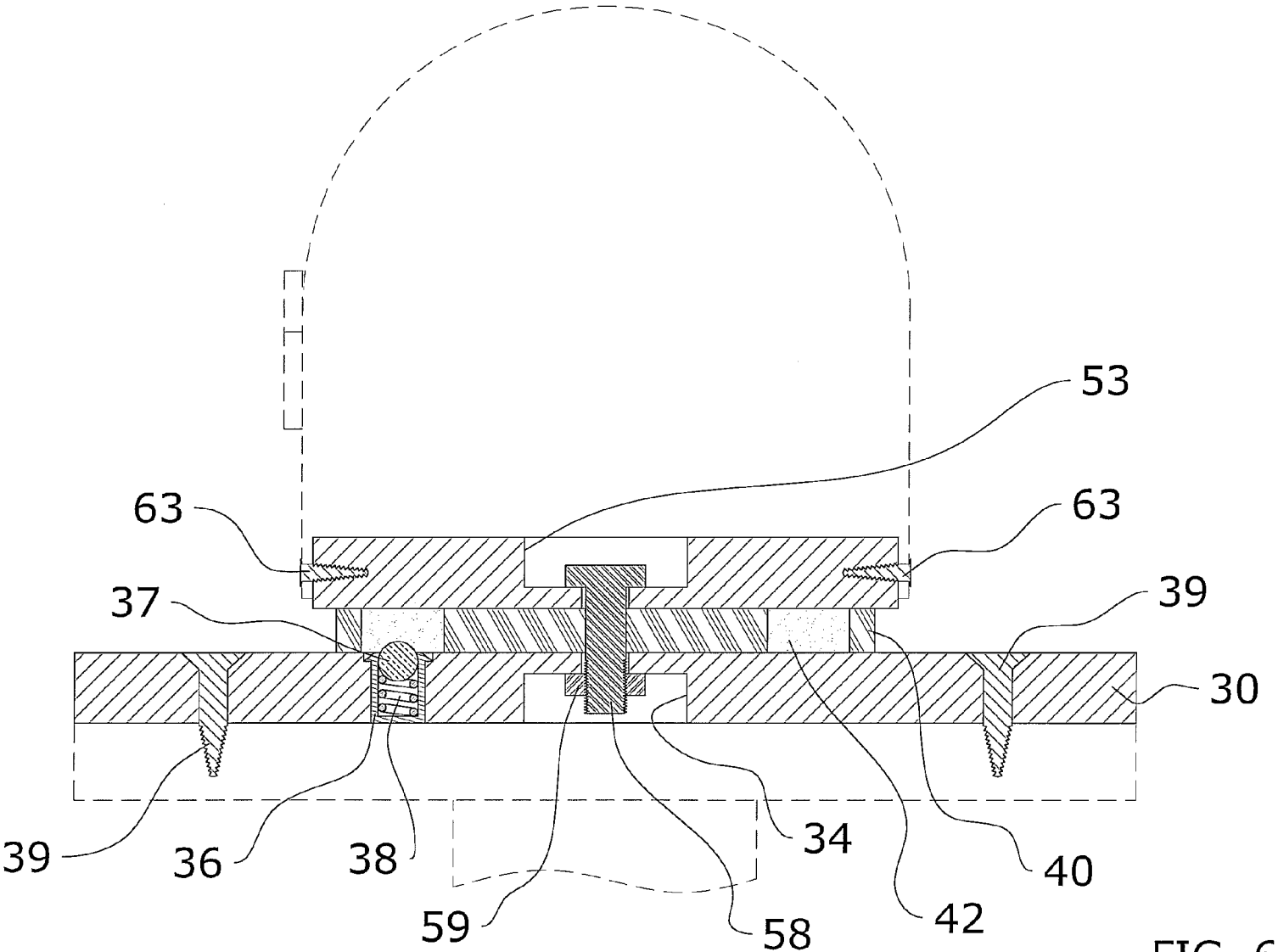
FIG. 6 is a cross-sectional view of the present invention in a second position.

When the spring 38 is in a relaxed or extended position the spring 38 preferably forces the locking member 37 above an upper horizontal surface of the first support member 30 as illustrated in FIGS. 4 and 6. When the spring 38 is in a compressed position the locking member 37 is preferably positioned below or flush with the upper horizontal surface of the first support member 30 as illustrated in FIG. 5.

The first support member 30 also preferably includes the first pivot aperture 33. The first pivot aperture 33 preferably extends vertically through the first support member 30. The first pivot aperture 33 is preferably positioned substantially near a concentric origin of the first support member 30 as shown in FIGS. 3 through 6. The first pivot aperture 33 preferably receives a second fastener 58. The second fastener 58 preferably secures the first support member 30, rotating member 40 and second support member 50 together. The second fastener 58 is preferably comprised of a bolt configuration. A receiving member 59 attached to the second fastener 58 is preferably comprised of a nut configuration.

The first pivot aperture 33 preferably includes a first recessed portion 34 extending upward from a lower horizontal surface of the first support member 30. The first pivot aperture 33 serves as a pivot point for the mailbox 60 upon the mailbox multi-position support system 10. It is appreciated that the first pivot aperture 33 and thus pivot point may be positioned at various places upon the first support member 30.

A first height of the first recessed portion 34 is preferably substantially similar or slightly greater than a second height of the receiving member 59 so the first support member 30 may be positioned flush upon the mounting member 22 of the mailbox post 20 as illustrated in FIGS. 4 through 6. The first height of the first recessed portion 34 is also preferably greater than an extended portion of the second fastener 58 through the first pivot aperture 33. It is also appreciated that the second fastener 58 may attach directly to the first support member 30 rather than utilizing the receiving member 59.

Figure 7:
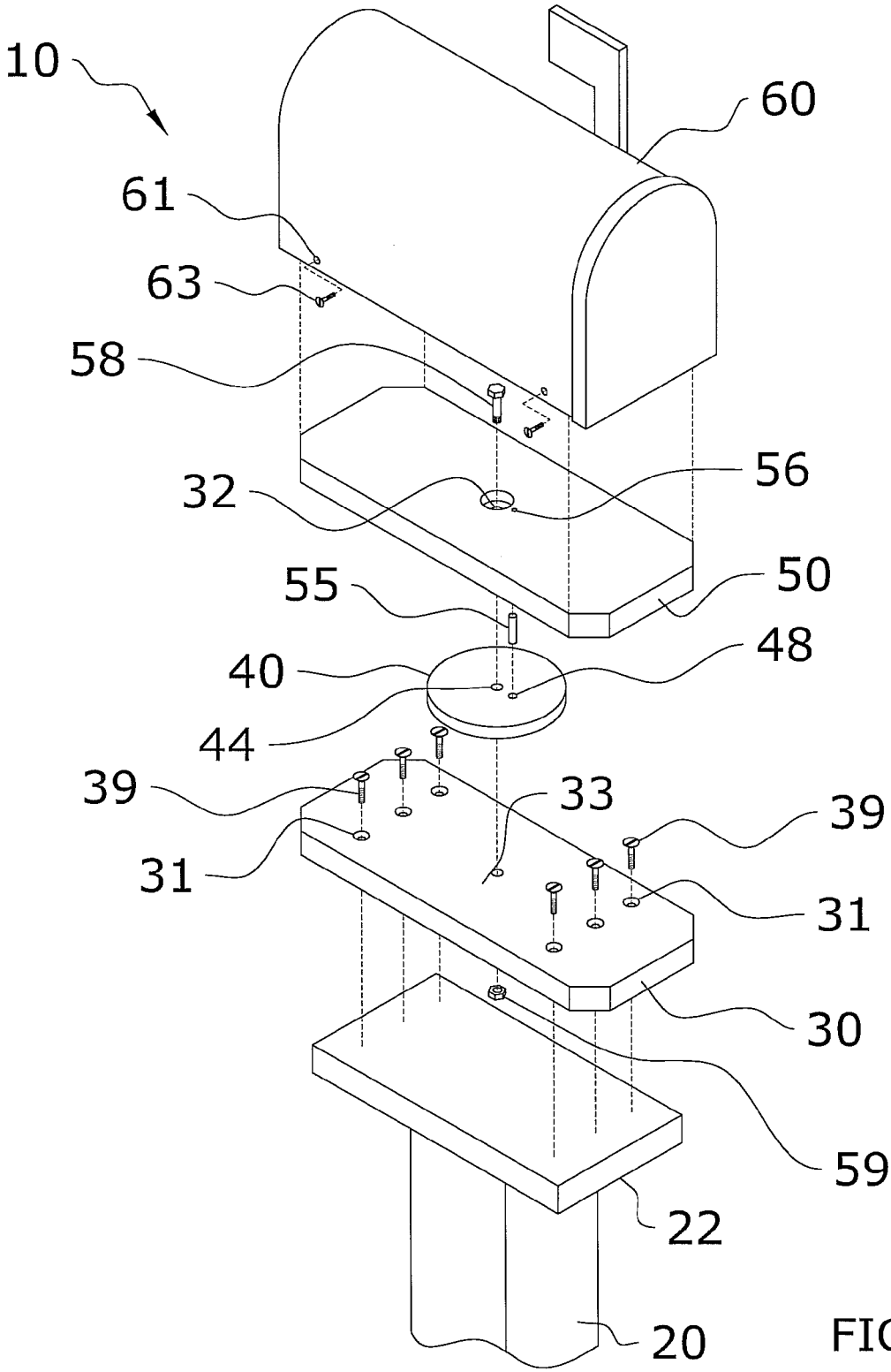
FIG. 7 is an exploded upper perspective view of an alternate configuration of the present invention.

In an alternate configuration of the mailbox multi-position support system 10 the channel member 36, the locking member 37 and the spring 38 are preferably omitted from the first support member 30 as shown in FIG. 7. The alternate configuration of the mailbox multi-position support system 10 is meant to provide a cheaper alternative mailbox multi-position support system 10.

C. Rotating Member

The rotating member 40 is preferably comprised of a circular configuration; however other configurations may be utilized with the rotating member 40, such as but not limited to rectangular or triangular. The rotating member 40 is also preferably comprised of a strong and weatherproof material, such as but not limited to wood, plastic or metal. The rotating member 40 is preferably positioned upon the upper horizontal surface of the first support member 30. A first diameter of the rotating member 40 is also preferably substantially similar or smaller than a first width of the first support member 30 so the rotating member 40 does not protrude from the outer edges of the first support member 30.

The rotating member 40 preferably includes a plurality of locking apertures 42. The locking apertures 42 are preferably radially spaced apart from one another. The locking apertures 42 further are preferably spaced 90 degrees from one another, wherein the locking apertures 42 are preferably spaced at 90 degrees, 180 degrees, 270 degrees and 360 degrees upon the rotating member 40 as illustrated in FIG. 3. It is appreciated however that the locking apertures 42 may be radially positioned at various places upon the rotating member 40 rather than the preferred embodiment.

The locking apertures 42 also preferably extend vertically through the rotating member 40. At least one of the locking apertures 42 is preferably positioned over the locking member 37 when the rotating member 40 is positioned upon the first support member 30 as shown in FIGS. 4 and 6. A first width of the locking apertures 42 is preferably substantially similar or slightly greater to a second width of the locking member 37 so as to securely receive the locking member 37 within the locking aperture 42.

The locking apertures 42 are also preferably comprised of elongated slot configuration so as to allow ample room for receiving the locking member 37. When the locking member 37 is positioned within the locking apertures 42, the mailbox 60 is preferably secured in place and prevented from rotating. The locking member 37 may be forced downward within the channel member 36 by applying a firm rotational force upon the mailbox 60, wherein the locking member 37 is forced below the locking aperture 42 by compression of the spring 38.

The rotating member 40 also preferably includes the second pivot aperture 44. The second pivot aperture 44 preferably extends vertically through the rotating member 40. The second pivot aperture 44 is preferably positioned substantially near a concentric origin of the rotating member 40 as shown in FIGS. 3 through 6. The second pivot aperture 44 preferably receives the second fastener 58. The second fastener 58 preferably secures the first support member 30, rotating member 40 and second support member 50 together. The second pivot aperture 44 is further preferably positioned directly above the first pivot aperture 33 of the first support member 30. The second pivot aperture 44 is also able to rotate about the second fastener 58 when the second fastener 58 is positioned within the second pivot aperture 44.

The rotating member 40 also preferably includes a first connecting aperture 48. The first connecting aperture 48 preferably extends downward from an upper horizontal surface of the rotating member 40. The first connecting aperture 48 preferably securely receives a securing member 55. The securing member 55 is preferably comprised of a pin configuration as illustrated in FIGS. 3 and 4.

In the alternate configuration of the mailbox multi-position support system 10 the locking apertures 42 are preferably omitted from the rotating member 40 as shown in FIG. 7. The alternate configuration of the mailbox multi-position support system 10 is meant to provide a cheaper alternative mailbox multi-position support system 10.

D. Second Support Member

The second support member 50 is preferably comprised of a rectangular shaped configuration as illustrated in FIG. 3. The second support member 50 is also preferably substantially similar in size and shape to the base of the mailbox 60 utilized with the mailbox multi-position support system 10. The second support member 50 further preferably fits within a recessed portion of the base of the mailbox 60. The second support member 50 is also preferably comprised of a strong and weatherproof material, such as but not limited to wood, plastic or metal.

The second support member 50 also preferably includes a third pivot aperture 52. The third pivot aperture 52 preferably extends vertically through the second support member 50. The third pivot aperture 52 is preferably positioned substantially near a concentric origin of the second support member 50 as shown in FIGS. 3 through 6. The third pivot aperture 52 preferably receives the second fastener 58; wherein the second fastener 58 preferably secures the second support member 50, rotating member 40 and second support member 50 together.

The third pivot aperture 52 preferably includes a second recessed portion 53 extending downward from an upper horizontal surface of the second support member 50. The third pivot aperture 52 serves as a pivot point for the mailbox 60 upon the mailbox multi-position support system 10. It is appreciated that the third pivot aperture 52 and thus pivot point may be positioned at various places upon the second support member 50 all which align with the second pivot aperture 44 of the rotating member 40 and the first pivot aperture 33 of the first support member 30.

A third height of the second recessed portion 53 is preferably substantially similar or slightly greater to a fourth height of the head of the second fastener 58 so the mailbox 60 may be positioned flush upon the second support member 50 as illustrated in FIGS. 3 through 6. The second fastener 58 is preferably comprised of a length substantially similar to the total height of the first support member 30, rotating member 40 and second support member 50. The second fastener 58 extends through the third pivot aperture 52, second pivot aperture 44 and first pivot aperture 33, wherein the receiving member 59 is preferably threadably attached to the second fastener 58 within the first recessed portion 34 of the first support member 30 as illustrated in FIGS. 3 through 6.

The second support member 50 also preferably includes a second connecting aperture 56. The second connecting aperture 56 preferably extends upward from a lower horizontal surface of the second support member 50. The second connecting aperture 56 preferably securely receives the securing member 55. The securing member 55 is thus secured within the second connecting aperture 56 of the second support member 50 and first connecting aperture 48 of the rotating member 40 thus preventing the second support member 50 from rotating without rotating the rotating member 40.

E. Mailbox

The mailbox 60 is preferably comprised of a standard mailbox 60. The mailbox 60 is further preferably comprised of an A-style mailbox, wherein the mailbox 60 includes a recessed base portion and a plurality of second mounting apertures 61. The second mounting apertures 61 are preferably positioned at a lower end of the mailbox 60 on the outside of the recessed base portion as shown in FIGS. 1 through 6.

The second support member 50 is preferably received by the recessed base portion. The second support member 50 is also preferably secured within the recessed base portion of the mailbox 60 by a plurality of third fasteners 63 extending through the second mounting apertures 61 and into the sides of the second support member 50 as illustrated in FIGS. 1 through 6.

F. In Use

In use, the mailbox 60 may be easily mounted to an existing mailbox post 20 and mailbox 60 configuration by first removing the third fasteners 63 from the mailbox 60 system thus removing the mailbox 60 from the mailbox post 20 and mounting member 22. The assembled first support member 30, rotating member 40 and second support member 50 are then attached to the mounting member 22 via the first fasteners 39 attaching the first support member 30 to the mounting member 22.

The mailbox 60 may now be positioned upon the second support member 50 and secured to the second support member 50 via the third fasteners 63. The mailbox 60 may now be rotated to the desired position. The mailbox 60 automatically locks at every 90, 180, 270 and 360 degree rotational position. To alter the orientation of the mailbox 60 a firm rotational force is simply applied to the side of the mailbox 60 which subsequently forces the locking member 37 below the corresponding locking aperture 42 and allowing the rotating member 40, second support member 50 and mailbox 60 to rotate about the first support member 30 and mailbox post 20.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. A mailbox multi-position support system, comprising:

a first support member including a locking member, wherein said first support member is attached to a mailbox post;

wherein said locking member extends upwardly from a first upper horizontal surface of said first support member and wherein said locking member is substantially offset from a concentric origin of said first support member;

a rotating member including a plurality of locking apertures, wherein at least one of said plurality of locking apertures receives said locking member, wherein said rotating member is rotatably attached to said first support member; and a second support member attached to a second upper horizontal surface of said rotating member, wherein a third upper horizontal surface of said second support member attaches to a mailbox;

wherein said locking member is forced below said at least one of said plurality of locking apertures and within said first support member by applying a firm rotational force to said mailbox.

2. The mailbox multi-position support system of claim 1, wherein said locking member is comprised of a spring plunger configuration.

3. The mailbox multi-position support system of claim 1, wherein said second support member attaches within a recessed base portion of said mailbox.

4. The mailbox multi-position support system of claim 1, wherein said plurality of locking apertures are radially positioned about said rotating member.

5. The mailbox multi-position support system of claim 4, wherein said plurality of locking apertures are spaced at a four axis orientation about said rotating member.

6. The mailbox multi-position support system of claim 1, including a securing pin, wherein said securing pin attaches said rotating member to said second support member in a non-rotating manner.

7. The mailbox multi-position support system of claim 1, wherein said first support member includes a first pivot aperture, said rotating member includes a second pivot aperture and said second support member includes a third pivot aperture, wherein said first aperture, said second aperture and said third aperture are each positioned at a substantially concentric origin of said first support member, said rotating member and said second support member.

8. The mailbox multi-position support system of claim 7, wherein said first aperture includes a recessed portion extending upwardly from a first lower horizontal surface of said first support member.

9. The mailbox multi-position support system of claim 7, wherein said third aperture includes a recessed portion extending downwardly from said third upper horizontal surface of said second support member.

10. The mailbox multi-position support system of claim 1, wherein said plurality of locking apertures are comprised of a horizontally elongated configuration.

11. A mailbox multi-position support system, comprising:

a first support member including a locking member, wherein said first support member is attached to a mailbox post;

wherein said locking member extends upwardly from a first upper horizontal surface of said first support member and wherein said locking member is substantially offset from a concentric origin of said first support member;

wherein said locking member is comprised of a spring plunger;

a rotating member including a plurality of locking apertures, wherein at least one of said plurality of locking apertures receives said locking member, wherein said rotating member is rotatably attached to said first support member; and a second support member attached to a second upper horizontal surface of said rotating member, wherein a third upper horizontal surface of said second support member attaches to a mailbox;

wherein said locking member is forced below said at least one of said plurality of locking apertures and within said first support member by applying a firm rotational force to said mailbox.

12. The mailbox multi-position support system of claim 11, wherein said second support member attaches within a recessed base portion of said mailbox.

13. The mailbox multi-position support system of claim 11, wherein said plurality of locking apertures are radially positioned about said rotating member.

14. The mailbox multi-position support system of claim 13, wherein said plurality of locking apertures are spaced at a four axis orientation about said rotating member.

15. The mailbox multi-position support system of claim 11, including a securing pin, wherein said securing pin attaches said rotating member to said second support member in a non-rotating manner.

16. The mailbox multi-position support system of claim 11, wherein said first support member includes a first pivot aperture, said rotating member includes a second pivot aperture and said second support member includes a third pivot aperture, wherein said first aperture, said second aperture and said third aperture are each positioned at a substantially concentric origin of said first support member, said rotating member and said second support member.

17. The mailbox multi-position support system of claim 16, wherein said first aperture includes a first recessed portion extending upwardly from a first lower horizontal surface of said first support member.

18. The mailbox multi-position support system of claim 16, wherein said third aperture includes a second recessed portion extending downwardly from said third upper horizontal surface of said second support member.

19. The mailbox multi-position support system of claim 11, wherein said plurality of locking apertures are comprised of a horizontally elongated configuration.

20. A mailbox multi-position support system, comprising:

a first support member including a locking member, wherein said first support member is attached to a mailbox post;

wherein said locking member extends upwardly from a first upper horizontal surface of said first support member and wherein said locking member is substantially offset from a concentric origin of said first support member;

a rotating member including a plurality of locking apertures, wherein at least one of said plurality of locking apertures receives said locking member, wherein said rotating member is rotatably attached to said first support member;

a second support member attached to a second upper horizontal surface of said rotating member, wherein a third upper horizontal surface of said second support member attaches to a mailbox;

wherein said locking member is forced below said at least one of said plurality of locking apertures and within said first support member by applying a firm rotational force to said mailbox;

wherein said locking member is comprised of a spring plunger configuration;

wherein said second support member attaches within a recessed base portion of said mailbox;

wherein said plurality of locking apertures are radially positioned about said rotating member;

wherein said plurality of locking apertures are spaced at a four axis orientation about said rotating member; and a securing pin, wherein said securing pin attaches said rotating member to said second support member in a non-rotating manner;

wherein said first support member includes a first pivot aperture, said rotating member includes a second pivot aperture and said second support member includes a third pivot aperture, wherein said first aperture, said second aperture and said third aperture are each positioned at a substantially concentric origin of said first support member, said rotating member and said second support member;

wherein said first aperture includes a first recessed portion extending upwardly from a first lower horizontal surface of said first support member;

wherein said third aperture includes a second recessed portion extending downwardly from said third upper horizontal surface of said second support member;

wherein said plurality of locking apertures are comprised of a horizontally elongated configuration.

* * * * *